US006086702A

United States Patent [19]

Rea

[11] Patent Number: 6,086,702

[45] Date of Patent: Jul. 11, 2000

[54] METHOD FOR PERSONALIZING BEVERAGE CONTAINER

[75] Inventor: Donald J. Rea, Chino Valley, Ariz.

[73] Assignee: Reaperot Ltd. Inc., Chino Valley, Ariz.

[21] Appl. No.: 09/114,843

[22] Filed: Jul. 14, 1998

[51] Int. Cl.[7] ..... B65C 3/08

[52] U.S. Cl. ..... 156/247; 156/297; 156/DIG. 9; 40/310; 283/75

[58] Field of Search ..... 156/247, 249, 156/265, 297, DIG. 9, DIG. 11, DIG. 13; 40/306, 310; 283/75, 80

[56] References Cited

U.S. PATENT DOCUMENTS

| | | | |
|---|---|---|---|
| 2,976,629 | 3/1961 | Brixius et al. . | |
| 4,759,139 | 7/1988 | Ricks | 40/310 X |
| 5,301,802 | 4/1994 | Nemeroff . | |
| 5,358,770 | 10/1994 | Evans | 40/310 X |
| 5,704,144 | 1/1998 | Groth | 40/306 |

*Primary Examiner*—Curtis Mayes
*Attorney, Agent, or Firm*—Tod R. Nissle, P.C.

[57] ABSTRACT

A method and apparatus for personalizing a beverage container utilizes a field labels which are removably mounted on the container. A portion of the labels are removed from the container, are organized in a desired sequence, and are remounted at a new location on the container.

1 Claim, 1 Drawing Sheet

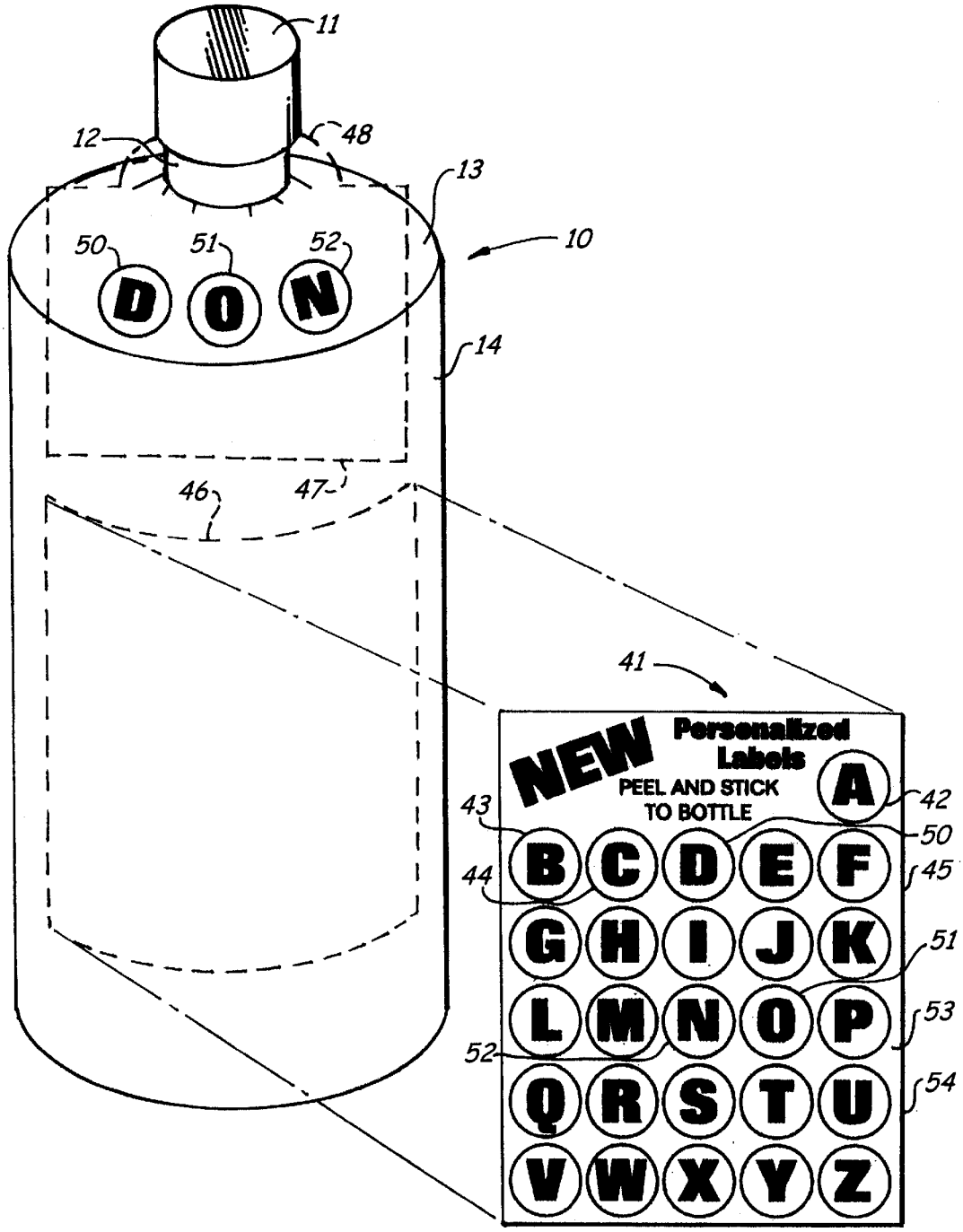
11
12
48
13
10
50
51
52
D
O
N
14
46
47
41
NEW
Personalized Labels
PEEL AND STICK TO BOTTLE
A
42
43
50
B C D E F
45
44
G H I J K
51
L M N O P
53
52
Q R S T U
54
V W X Y Z

METHOD FOR PERSONALIZING BEVERAGE CONTAINER

This invention relates to a method and apparatus for identifying the user of a beverage container.

More particularly, the invention relates to a method and apparatus for personalizing a beverage container to facilitate identification of the container when it is intermingled with containers of like appearance.

Bottles and other beverage containers are widely utilized throughout the world. Smaller eight and sixteen ounce bottles with "pop-tops" have become especially popular. When the pop-top is opened by pulling it outwardly away from the bottle, an individual drinks beverage which flows under gravity from within the bottle out through the pop-top. When the pop-top is pushed toward the bottle and closed, the remaining beverage is sealed within the bottle.

One long existing problem associated with bottled beverages occurs when each member in a group of individuals has his or her own beverage bottle (or other container) of like appearance. When two or more individuals set their beverage bottle on a table and subsequently return to claim the bottle, it often is difficult to determine which bottle belongs to which individual, and, as a result, an individual often ends up drinking beverage from a bottle which was earlier utilized by another person. Such intermixing of beverage bottles contributes to uncleanliness and to the spread of disease.

Accordingly, it would be highly desirable to provide an improved method and apparatus to enable an individual readily to recognize his or her beverage container after the beverage container is intermixed with other containers of like appearance.

Therefore, it is a principal object of the invention to provide an improved method and apparatus for distributing and using beverage containers.

A further object of the invention is to provide an improved method and apparatus for distinguishing a beverage container after it has been intermixed with a plurality of containers of like size and appearance.

Still another object of the invention is to reduce the likelihood that diseases will be spread during the utilization at a social or business event of sealed beverages containers of like appearance which each are intended to be opened and utilized by an individual, to be set down, and to be subsequently again picked up and utilized by the same individual.

These and other further and more specific objects and advantages of the invention will be apparent to those skilled in the art from the following detailed description thereof, take in conjunction with the figure, which illustrates a bottle of water or other beverage constructed in accordance with the principles of the invention.

Briefly, in accordance with my invention, I provide improvements for a hand-held portable beverage container. The improvements comprising means for personalizing the container to permit the ready identification of the person using the container. The improvements include a primary label mounted on the container; and a field of secondary labels removably attached to the primary label. Each of the secondary labels include a front side and a back side; at least one letter of an alphabet imprinted on said front side; and, adhesive attached to the back side to permit the secondary label to be peeled off the primary label and adhered to the container.

In another embodiment of the invention, I provide an improved method for personalizing a beverage container. The method includes the steps of providing a container of an ingestible liquid; providing a field of labels each including a front side and a back side and including at least one letter of an alphabet imprinted on the front side; mounting the labels on the container each at a selected location to permit each label to be removed and adhered to the container at a location other than said selected location; and, removing selected ones of the labels and attaching the back side of each of the removed labels to the container in a selected identification sequence.

In a further embodiment of my invention, I provide improvements for a hand-held portable container holding a beverage. The improvements comprise apparatus for personalizing the container to permit the ready identification of a person using the container. The improvements include a primary label mounted on the container; and, a field of secondary labels removably attached to said primary label. Each of the secondary labels includes a front side and a back side; at least one letter of an alphabet imprinted on the front side; and, adhesive attached to the back side to permit the secondary label to be peeled off the primary label and adhered to the container. The improvements also include a plurality of differing secondary images formed on the primary label each beneath a different one of the secondary labels and corresponding to the letter imprinted on the secondary label such that the secondary image is exposed to view when the secondary label is removed from the primary label.

Turning now to the FIGURE, which depicts the presently preferred embodiments of the invention for purposes of illustrating the invention and not by way of limitation of the scope of the invention, the drawing illustrates a bottle 10 containing water or another beverage. The bottle 10 includes a hollow cylindrical outer surface 14, includes a top conical surface 13, includes externally threaded neck 12 depending from surface 13, and includes an internally threaded cap 11 which turns onto externally threaded neck 12 to seal bottle 10 closed. Cap 11 is removed from bottle 10 and an individual places neck 12 in his mouth, and tips bottle 10 upwardly to cause water to flow out from bottle 10 under gravity through neck 12 and into the user's mouth. Bottle 10 is fabricated from plastic, glass, or any other desired material. The shape and dimension of bottle 10 or of another container utilized in place of bottle 10 can vary as desired.

Primary label 41 includes rectangular backing panel 45. Panel 45 ordinarily is pliable or is substantially rigid. A plurality or field of circular secondary labels 42 to 44, 50 to 52 are removably attached to the front surface 53 of backing panel 45 of primary label 41. Each secondary label includes a circular front surface on which a letter of the alphabet "A" (secondary label 42), "B" (secondary label 43), "C" (secondary label 44), etc. is imprinted or otherwise formed. Each secondary label also includes a circular back surface which is adjacent and faces the front surface 53 of backing panel 45 and which is coated with adhesive which removably secures the secondary label to backing panel 45. When a secondary label 42 to 44, 50 to 52 is peeled off primary label 41, the adhesive adheres to the back side of the secondary label and peels off the front surface of backing panel 45. The back side 54 of backing panel 45 of primary label 41 is coated with adhesive or with other attachment means and is attached to cylindrical surface 14 in the manner indicated by dashed lines 46 in the figure.

In addition to being glued to surface 14, label 41 or another label having any desired shape and dimension can be mounted on a bottle 10 in any desired manner. For example, label 41 can be shaped and dimensioned to include an opening which slides over neck 13 such that label 41 can be positioned on bottle 10 in the location indicated by dashed lines 47 in the drawing. When label 47 is mounted in the manner illustrated by dashed lines 47, it need not be coated with adhesive on its back side in the manner that backing 45 is coated on its back side 54.

Similarly, if desired, primary label 41 can be eliminated and the back side of each secondary label 42 to 44, 50 to 52 can be adhered directly to cylindrical surface 14 with adhesive which can be peeled off surface 14 and which remains adhered to the back surface of the secondary label such that the secondary label can be reattached to bottle 10 at a new separate location.

In use, a primary label 41 (including a field of secondary labels 50 to 52 and 42 to 44 mounted on label 41) is mounted at a selected first location on each of a plurality of bottles 10, or, a field of individual secondary labels 50 to 52 and 42 to 44 (i.e., a field of secondary labels not attached to a label 41) is mounted directly at a selected first location on surface 14 of each of a plurality of bottles 10. The location on a bottle 10 at which a label 41 or a field of secondary labels is mounted need not be identical for each bottle 10. Bottles 10 typically are of equal size and appearance, although this need not be the case. The secondary labels 50 to 52 and 42 to 44 can subsequently each be peeled off label 41 or surface 14, as the case may be. A plurality of individuals each takes one of the bottles provided with label 41 and/or secondary labels 50 to 52, etc. In order to personalize his bottle, an individual removes, typically one-at-a-time, only a selected portion (i.e., fewer than all of the secondary labels) of the secondary labels and mounts them at a second location on bottle 10 to spell his first or last name, nick name, initials, or other identifying word or sequence of letters. Removing only a selected portion of secondary labels from backing panel 45 comprises removing one or more secondary labels and comprises removing fewer than all twenty-seven of the secondary labels (one for each letter of the alphabet) shown in the drawing. For example, if the individual wishes to spell his first name, DON, he peels off each of circular secondary labels 50, 51, 52 from a first location on bottle 10 (for example, from panel 45 on cylindrical surface 14) and uses the adhesive on the back of these labels to adhere the labels 50 to 52 to bottle 10 at a second location (i.e., on surface 13) in a selected identification sequence in the manner illustrated in the drawing to spell DON. Consequently, it is critical in the practice of the invention that secondary labels 42 to 44 and 50 to 52 have the ability to be individually removed from bottle 10 (so that only a portion of the secondary labels can be removed), to be organized in a desired identification sequence, and to be mounted in that identification sequence on bottle 10 at a second location separate from the location at which the secondary labels are originally mounted on bottle 10. As used herein, secondary labels are mounted on bottle 10 at a second location if the secondary labels are attached to panel 45 at a location separate from the original location of the secondary labels on panel 45. Accordingly, mounting secondary labels on a label or other member mounted on bottle 10 also, along with mounting secondary labels directly on a surface of bottle 10, constitutes mounting the secondary labels on bottle 10. In the event each of secondary labels 50 to 52 and 42 to 44 does not have adhesive on its back, tape or any other fastening means can, after a secondary label is removed from label 41, be utilized to secure the secondary label at a desired second location on bottle 10.

While numbers or any other indicia or symbols can be formed on secondary labels 50 to 52, 42 to 44, etc. in place of or in combination with letters, and, while more than one letter or other symbol can be formed on each secondary label 50 to 52, it is presently desired that each secondary label having only a single letter of the alphabet formed or imprinted thereon and that there be at least twenty-seven secondary labels, one for each letter of the alphabet. The number of secondary labels can, however, vary as desired.

It is also presently preferred that the secondary labels form a "field" or grid including a plurality of rows and columns. A single long line of letters does not comprise a field. Two vertically oriented (or horizontally oriented, canted, etc.) lines of secondary labels comprises a field, even if the lines are spaced apart. It is, however, preferred that the rows and columns in a field be adjacent in the manner shown in the drawings. In the drawing the secondary labels form a field including five vertically oriented columns and six horizontally oriented rows. The colors and type styles utilized to forms the indicia and/or symbols imprinted on primary and secondary labels 41, 50 to 52, 42 to 44, can vary as desired.

When label 41 is utilized, a "ghost" symbol can be imprinted on the front face 53 of label 41 directly beneath each secondary label 41 to 44, 50 to 52. When a secondary label is peeled off label 41 the ghost symbol imprinted on face 53 is exposed. The ghost symbol presently comprises the symbol which is imprinted on the front side of the secondary label which covers and is peeled off the ghost symbol. For example, when label 42 is peeled off label 41, the ghost letter "A", which is imprinted on surface 53, is exposed. When label 43 is removed from label 41, the ghost letter "B" is exposed. However, the ghost letter "A" imprinted on surface 53 preferably has an appearance different from that of the letter "A" imprinted on label 42 so that a user can readily ascertain by looking at the ghost letter "A" that label 42 has been removed from label 41. For example, if the letter "A" imprinted on the front side of label 42 (and all the other letters imprinted on the each of the secondary labels) is black, the corresponding ghost letter "A" imprinted on face 53 can be light gray; or, if the letter "A" imprinted on the front of label 42 is red, the ghost letter "A" imprinted on face 53 can be green. If primary label 41 is not utilized, each secondary label 42 to 44, etc. can be utilized on an auxiliary circular backing layer. This auxiliary backing layer has a diameter equal to that of the secondary label with which it is utilized, has a back surface provided with adhesive which permanently secures the backing layer to bottle 10, and, has a smooth front "release" surface which receives the peel-away adhesive on the back side of the secondary label and which permits the peel-away adhesive to be separated from said smooth front "release" surface while the peel-away adhesive remain on the back side of the secondary label.

As would be appreciated by those of skill in the art, the primary label 41 and/or secondary labels 42 to 44 etc. of the invention can be utilized on and to personalize pacifiers, life jackets, and other objects in additional to bottles and other containers filled with ingestible liquids.

The shape and dimension of each primary and/or secondary label can vary as desired, as can the locations on bottle 10 where the labels are initially secured. A user removing certain selected ones of the secondary labels to spell his or her name can apply the secondary labels at any desired location on bottle 10 to spell his or her name, initials, etc.

Having described my invention in such terms as to enable those skilled in the art to understand and practice it, and having identified the presently preferred embodiments thereof,

I claim:

1. A method for personalizing a beverage dispenser including the steps of (a) providing a container holding a beverage;

(b) providing a field of labels each including (i) a front side and a back side, (ii) at least one letter of the alphabet imprinted on said front side;

(c) mounting said labels on said container each at a selected location to permit said labels to be removed and adhered to said container at a location other than said selected location; and, (d) removing only a selected portion of said labels from said container and attaching said back side of each of said portion to said container in a selected identification sequence at a location other than said selected location.

* * * * *